US007814675B2

(12) United States Patent
Venderley et al.

(10) Patent No.: US 7,814,675 B2
(45) Date of Patent: Oct. 19, 2010

(54) APPARATUS AND METHOD FOR AIDING IN HANGING AN OBJECT ON A WALL

(75) Inventors: David J. Venderley, Ft. Wayne, IN (US); David Maberson, Ft. Wayne, IN (US)

(73) Assignee: Midwest Tool and Die, Corporation, Fort Wayne, IN (US)

( * ) Notice: Subject to any disclaimer, the term of this patent is extended or adjusted under 35 U.S.C. 154(b) by 270 days.

(21) Appl. No.: 12/107,171

(22) Filed: Apr. 22, 2008

(65) Prior Publication Data

US 2009/0261227 A1 Oct. 22, 2009

(51) Int. Cl.
*G01B 3/02* (2006.01)

(52) U.S. Cl. ..... 33/613; 33/645; 33/451; 33/484

(58) Field of Classification Search ..... 248/475.1
See application file for complete search history.

(56) References Cited

U.S. PATENT DOCUMENTS

| | | | | | |
|---|---|---|---|---|---|
| 3,371,423 | A | * | 3/1968 | Paul | 33/666 |
| 3,516,165 | A | | 6/1970 | Pfeffer | |
| 3,530,591 | A | * | 9/1970 | Moffitt | 33/613 |
| 4,241,510 | A | | 12/1980 | Radecki | |
| 4,813,149 | A | | 3/1989 | Herkimer | |
| 5,092,057 | A | | 3/1992 | Hoenig, Sr. | |
| 5,103,524 | A | | 4/1992 | Vowles | |
| 5,103,573 | A | * | 4/1992 | Ehling et al. | 33/613 |
| 5,451,027 | A | | 9/1995 | McHenry | |
| 5,471,760 | A | | 12/1995 | Farris | |
| 6,029,362 | A | * | 2/2000 | Miodragovic | 33/666 |
| 6,293,028 | B1 | * | 9/2001 | Sylvia | 33/613 |
| 6,305,093 | B1 | * | 10/2001 | Venola | 33/451 |
| 6,421,928 | B1 | * | 7/2002 | Miller | 33/520 |
| 6,463,666 | B1 | | 10/2002 | Szumer | |
| 6,473,983 | B1 | * | 11/2002 | Gier | 33/613 |
| 6,663,075 | B2 | | 12/2003 | Zuller | |
| 6,785,977 | B1 | * | 9/2004 | Crichton | 33/613 |
| 6,883,224 | B2 | | 4/2005 | Rimback | |
| 6,988,324 | B2 | * | 1/2006 | Vicario | 33/812 |
| 7,155,840 | B1 | | 1/2007 | Carbonaro | |
| 7,210,243 | B2 | * | 5/2007 | Schmidt et al. | 33/613 |
| 7,316,078 | B2 | | 1/2008 | Hagman | |
| 7,566,042 | B1 | * | 7/2009 | Yates | 248/466 |
| 2007/0234584 | A1 | | 10/2007 | Robins | |

* cited by examiner

*Primary Examiner*—J. Allen Shriver, II
*Assistant Examiner*—Alaeddin Mohseni
(74) *Attorney, Agent, or Firm*—Woodard, Emhardt, Moriarty, McNett & Henry LLP

(57) ABSTRACT

An apparatus for aiding in hanging an object on a wall comprises an elongate horizontal bar having a longitudinal axis and a top surface and at least two holders slideable on the bar along the longitudinal axis. Each of the holders includes at least one projection for holding an object hanger at the desired mounting location while a fastener is used to mount the object hanger on the wall. The assembly may optionally include at least one level mechanism for indicating when the apparatus is level. Positioning at least two of the at least two holders spaced apart from each other on the bar allows for properly positioning and mounting the object hangers held by the projections at the desired locations on the wall.

19 Claims, 3 Drawing Sheets

APPARATUS AND METHOD FOR AIDING IN HANGING AN OBJECT ON A WALL

FIELD OF THE DISCLOSURE

The present invention relates generally to the field of wall hanging aids, and more specifically provides an apparatus and method for aiding in hanging an object on a wall.

BACKGROUND OF THE DISCLOSURE

When hanging pictures and other objects on the wall, it can be difficult to mount the hooks or hangers in the right location on the wall so the picture hangs exactly where desired. When mounting more than one hook, it can also be difficult to mount the hooks so that they are horizontally aligned or level. Ensuring that the hooks are level is important so that the picture will be oriented properly in a level position. Measuring the precise locations where the hooks are to be mounted often requires careful and time consuming measurements or approximations, and can often result in trial and error approaches where extra holes are punched into the wall which would then need to be repaired.

Accordingly, an improved apparatus and method for aiding in hanging an object from a wall is desired.

SUMMARY OF THE DISCLOSURE

In certain embodiments, an apparatus for aiding in hanging an object on a wall comprises an elongate horizontal bar having a longitudinal axis and a top surface and at least two holders slideable on the bar along the longitudinal axis. Each of the holders includes at least one projection for holding an object hanger at the desired mounting location while a fastener is used to mount the object hanger on the wall. Positioning at least two of the holders spaced apart from each other on the bar allows for properly positioning and mounting the object hangers held by the projections at the desired locations on the wall.

In certain embodiments, an apparatus for aiding in hanging an object on a wall comprises an elongate horizontal bar having a longitudinal axis and a top surface and at least four clamping members slideable on the bar along the longitudinal axis. Each of the clamping members includes two opposing side projections which are able to cooperate with one of the projections on an adjacent one of the clamping members to hold an object hanger between the clamping members at desired positions on the wall. The clamping members are configured to hold the object hangers such that the back surfaces of the object hangers at least partially contact the wall so that the object hangers may be mounted to the wall while being held at the desired positions by the clamping members.

In certain embodiments, a kit for aiding in hanging an object on a wall comprises an elongate horizontal bar having a longitudinal axis, a top surface, and a central channel defined in the bar and extending along the longitudinal axis. The kit also includes at least four holders slideable on the bar along the longitudinal axis. Each of the holders includes two opposing side projections which are configured to be able to cooperate with one of the projections on an adjacent one of the clamping members to hold an object hanger between the clamping members at desired positions on the wall. Each of the holders includes at least one U-shaped member configured to receive a bubble level. Additionally, each of the holders defines a vertical slot configured to slideably receive an extension arm. The kit further includes at least two bubble levels for indicating when the apparatus is level. The levels are configured to snap-fit into the U-shaped members so that at least two of the holders carry the at least two bubble levels. Additionally, the kit includes at least four extension arms which are configured to be slideably received in the channel or the vertical slots of the holders. The holders are configured to hold the object hangers such that the back surfaces of the object hangers at least partially contact the wall so that the object hangers may be mounted to the wall while being held in position by the holders.

DESCRIPTION OF THE ILLUSTRATED EMBODIMENTS

Figure 1:
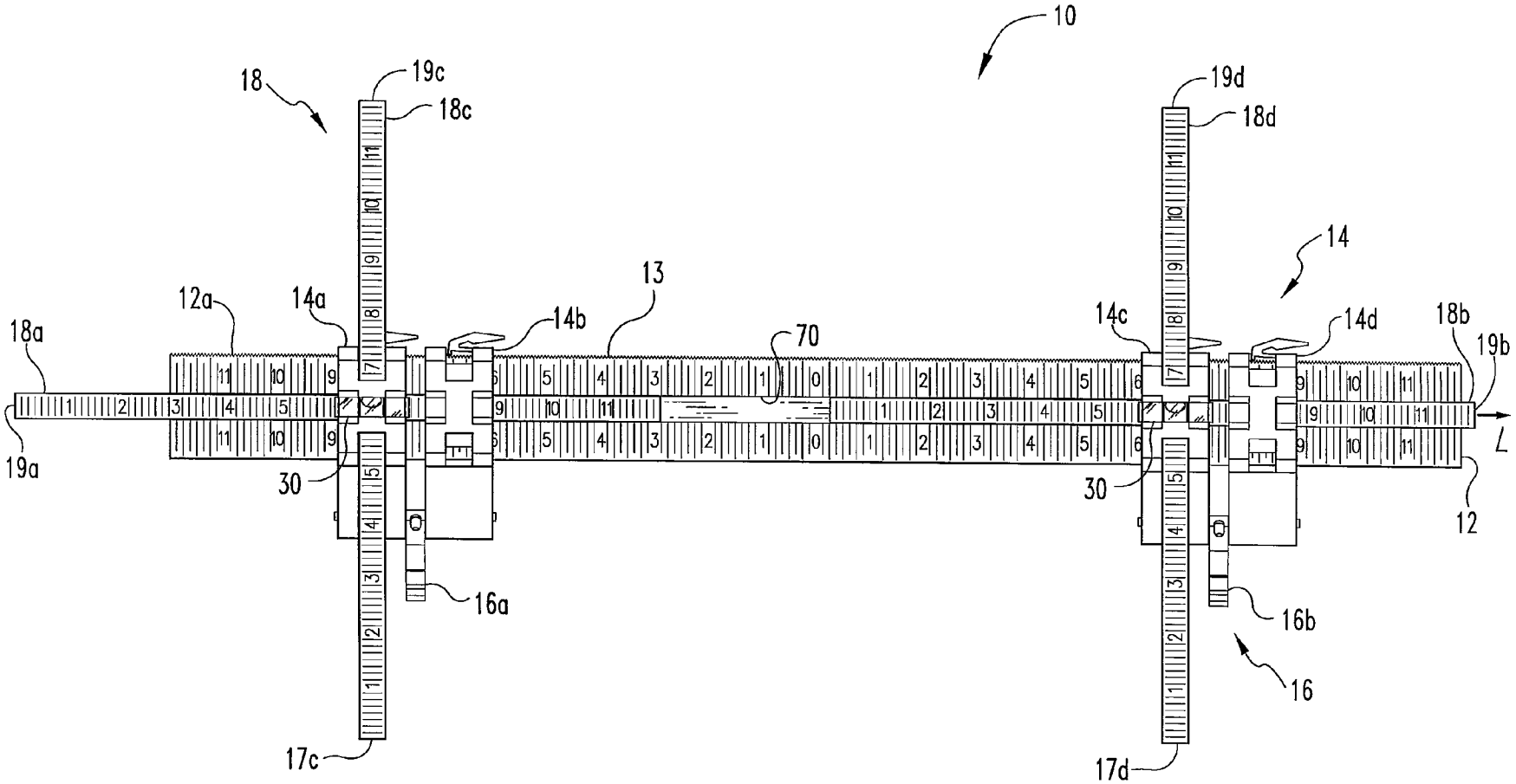
FIG. 1 is a front view of the assembly according to one embodiment.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein are contemplated as would normally occur to one skilled in the art to which the disclosure relates.

The present disclosure is generally directed to an apparatus and method for aiding in hanging an object on a wall. In certain embodiments, a wall hanging aid assembly includes an elongate horizontal bar and four holders slideable along the bar. The holders include opposing side projections which cooperate with each other to hold object hangers between the holders. Accordingly, the holders can hold two object hangers near opposing ends of the bar while the object hangers are mounted to the wall. At least two of the holders may include bubble levels to indicate when the holders are level and ensure that the object hangers are being mounted at the proper locations so that the object will be level when hung on the wall. The assembly may further include extension arms to measure distances from other objects and/or to visual the size and location of the object to be hung on the wall.

There is illustrated in FIG. 1 a wall-hanging-aid assembly 10 including an elongate horizontal bar 12 and a plurality of clamping members or holders 14 slideable along longitudinal axis L of the bar. The holders 14 are configured to hold hooks or object hangers 16 between them while the object hangers are mounted to a wall surface. The assembly 10 may optionally include a plurality of extension arms 18 slideable with respect to the bar and the holders to measure distances and/or visual the overall size and location of the object on the wall.

Figure 2:
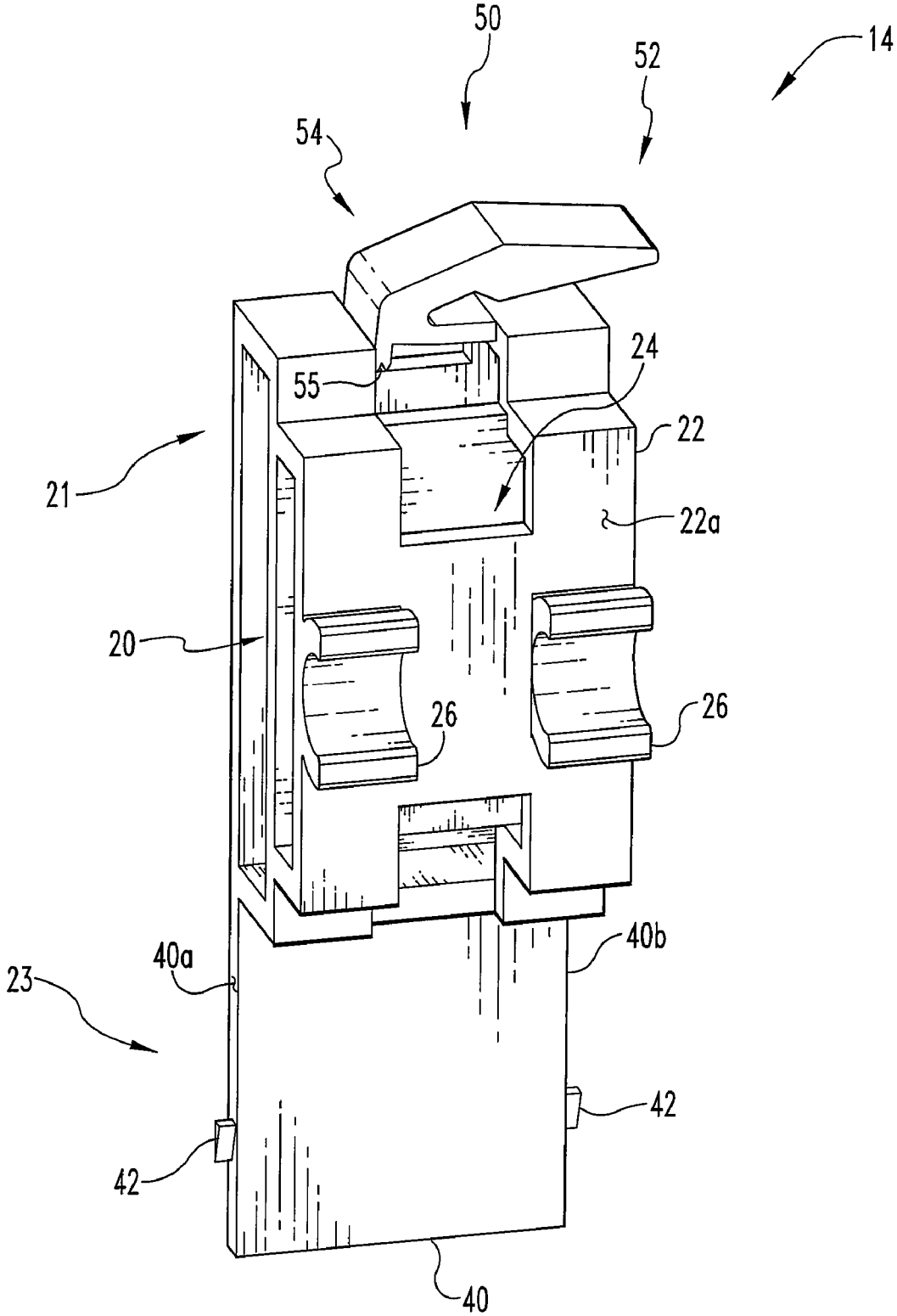
FIG. 2 is a perspective view of a holder of the assembly according to the embodiment of FIG. 1.

FIG. 2 shows a perspective view of a holder 14. As illustrated, holder 14 includes an upper portion 21 defining a horizontal passageway 20 configured for passage of bar 12. Holder 14 is sized and configured so that holder 14 is slideable along bar 12, with bar 12 passing through passageway 20, so that a user may relatively easily position holder 14 at desired locations along the bar. In the illustrated embodiment, passageway 20 is rectangular in cross-sectional shape corresponding to the rectangular cross-sectional shape of bar 12. However, it should be appreciated that passageway 20 and bar 12 could be shaped different as would occur to one skilled in the art.

Holder 14 further includes a front portion 22 positioned forward of passageway 20 which at least partially defines a vertical slot 24 configured for slideable receipt of one extension arm 18. In certain embodiments, slots 24 and extension arms 18 are configured such that the extension arms friction fit within the slots to prevent the arms from falling through the slots when assembly 10 is positioned up against the wall surface. In such cases, a user may apply a slight amount of force to overcome the friction fit and move the arms within the slots as desired. Front portion 22 has a front surface 22*a* from which two U-shaped members 26 extend. In the illustrated embodiment, bubble levels 30 (see FIG. 1) are configured to snap-fit into U-shaped members 26. However, it should be appreciated that the levels can be associated with holder 14 in various other manners as would occur to one skilled in the art. In alternative embodiments, one or more of the levels is mounted to bar 12. In certain embodiments, other level mechanisms may be used in connection with assembly 10 to indicate when the assembly is level. In other embodiments, assembly 10 does not include any type of leveling mechanism and the user may level assembly 10 using eyesight alone and/or other mechanisms not associated with assembly 10.

Holder 14 further includes a lower portion 23 having a downwardly extending flange 40 with opposing side surfaces 40*a* and 40*b*. In certain embodiments, holder 14 includes opposing side projections 42 extending from side surfaces 40*a* and 40*b* of flange 40. Projections 42 are configured to cooperate with other projections on adjacent holders to hold an object hanger between the adjacent holders, as will be discussed in greater detail with reference to FIGS. 3 and 4. Object hangers 16 can be mounted to the wall surface while being held in the proper position by holders 14.

Additionally, holder 14 includes a top lever clamp 50 to engage top surface 12*a* of bar 12 to prevent slideable movement of holder 14 along bar 12 when the holder is positioned at the desired location. Clamp 50 includes a first depressible end 52 and a second engaging end 54 designed to engage top surface 12*a* of bar 12. In the illustrated embodiment, end 54 includes one or more splines 55 configured to engage a plurality of splines 13 on top surface 12*a*. The engagement of the splines substantially prevents slideable movement of holder 14 along bar 12. To release the engagement and allow slideable movement, clamp 50 can be depressed at end 52 which pulls splines 55 on end 54 out of engagement with splines 13 on top surface 12*a* and allows the holder to freely slide along bar 12. In certain embodiments, depressing end 52 moves end 54 upward via the location of the substantially rigid engagement of clamp 50 with upper portion 21 of holder 14.

For discussion purposes and as one example embodiment, holders 14 illustrated in FIG. 1 are identical, interchangeable, and will be designated 14*a* through 14*d*. In the illustrated embodiment, there are four hangers 14. However, it should be appreciated that the hangers positioned along bar 12 could number more or less than four as would occur to one skilled in the art. In the illustrated embodiment, holders 14*a* and 14*b* are positioned together near one end of bar 12 and holders 14*c* and 14*d* are positioned together near the other end of bar 12. Holders 14*a* and 14*b* together hold object hanger 16*a* for mounting to the wall surface and holders 14*c* and 14*d* together hold object hanger 16*b* for mounting to the wall surface. In this way, object holders 16 can be held at the desired positions on the wall via assembly 10 while fasteners are used to mount the object hangers to the wall. In many situations in which objects are hung via hanging wires, it can be desirable to mount two object hangers to the wall at level positions to hang the object via the wire. In other situations, a user may desire to hang the object using only one object hanger 16. In such cases, a user can slide holders 14*b* and 14*c* along bar 12 so that they are adjacent each other at the desired location and position the selected object hanger between the holders via projections 42.

As mentioned above, bubble levels 30 may be included with assembly 10 and snap-fit into U-shaped members 26 on holders 14 so that a user can level the assembly 10 before mounting object hangers 16 to the wall. As an example, in FIG. 1 there are two illustrated bubble levels 30. However, it should be appreciated that there could be more or less than two bubble levels held by holders 14.

Figure 3:
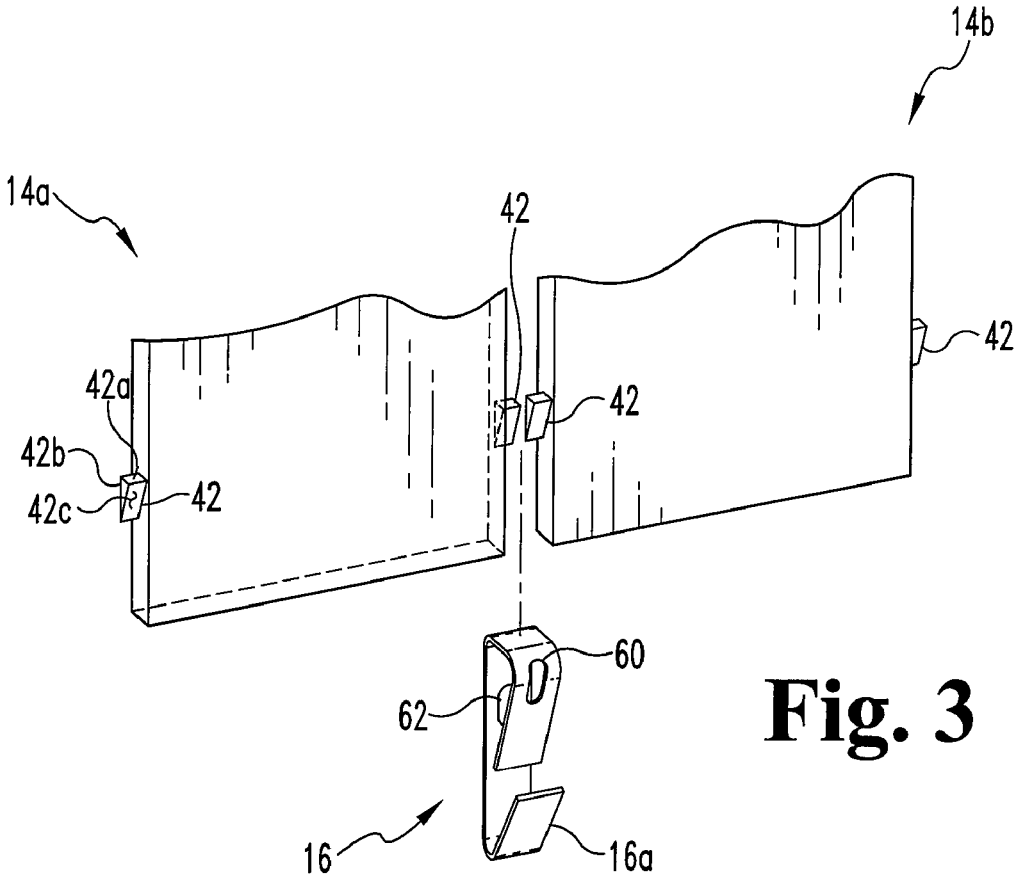
FIG. 3 is a perspective view of portions of adjacent holders of the assembly according to the embodiment of FIG. 1.
Figure 4:
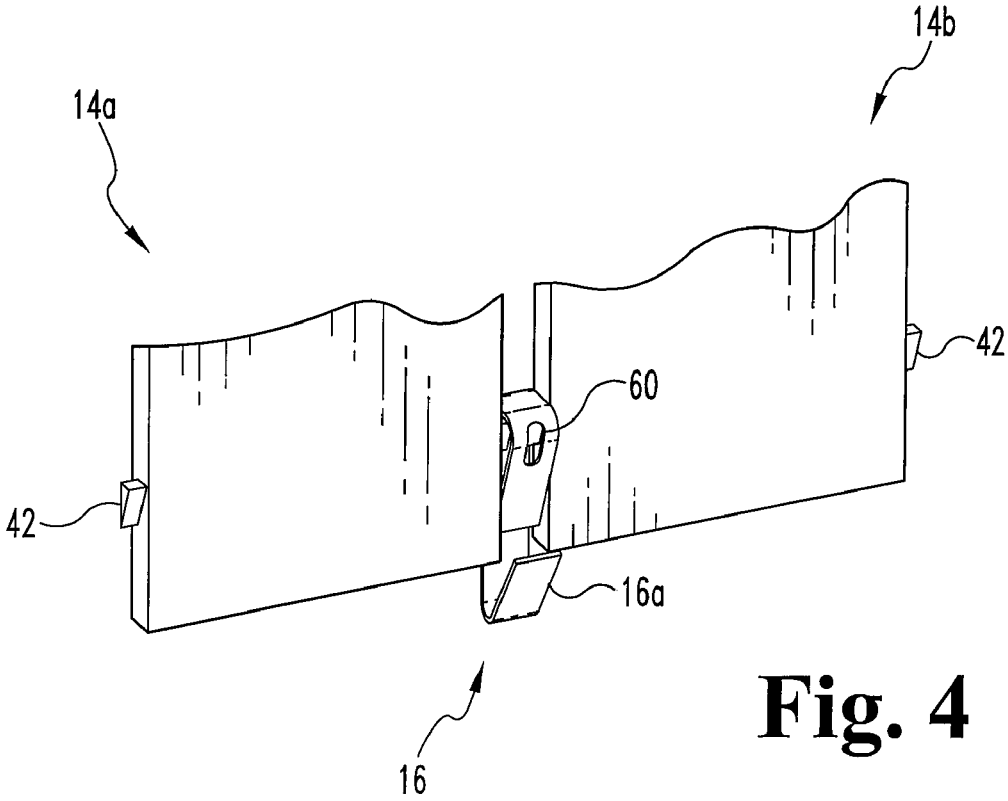
FIG. 4 is a perspective view of portions of adjacent holders of the assembly and an object holder according to the embodiment of FIG. 1.

For clarity, FIG. 3 and are show close-up, perspective views of portions of holders 14*a* and 14*b* positioned adjacent each other, with projections 42 on the holders holding an object hanger 16*a* in FIG. 4. In certain embodiments, projections 42 each include a top surface 42*a*, a back surface 42*b* and an angled front surface 42*c*, together forming a triangular cross-sectional shape. However, it should be appreciated that projections 42 can be shaped and sized differently as would occur to one skilled in the art. As illustrated in FIG. 4, object hanger 16*a* rests on top surfaces 42*a* of two adjacent projections 42. Object hanger 16 defines a front hole 60 and a back hole 62 through which a fastener can be inserted to mount the object hanger to the wall. In certain embodiments, a nail may be used to mount the object hanger. In the illustrated embodiment, holes 60 and 62 are offset from each other such that the fastener is inserted at an angle to the wall surface. In such cases, the angling of front surfaces 42*c* facilitates insertion of the fasteners at the necessary angle and reduces the likelihood of interference with the fasteners by projections 42. The sizing and configuration of projections 42 allows for object hanger 16*a* to be mounted to the wall surface while being held in position by holders 14.

Assembly 10 may also optionally include a plurality of elongate extension arms 18. In the illustrated embodiment, there are four arms 18 which are identical, interchangeable and will be designed 18*a* through 18*d*. As illustrated, arms 18*a* and 18*b* have outer ends 19*a* and 19*b*, respectively, and arms 18*c* and 18*d* have top ends 19*c* and 19*d*, respectively, and bottom ends 17*c* and 17*d*, respectively. Additionally, arms 18*a* through 18*d* as well as bar 12 may optionally include measurement indicator lines thereon, as illustrated. In the illustrated embodiment, bar 12 is about 24 inches in length and each arm 18 is about 12 inches in length. However, it should be appreciated that the illustrated lengths are merely examples and the bar and extension arms can be longer or shorter in length as desired.

In the illustrated embodiment, bar 12 defines a central channel 70 extending along longitudinal axis L. Arms 18 are configured to slideably translate within channel 70, and as illustrated in FIG. 1, can telescopically extend beyond bar 12. In certain embodiments, channel 70 and extension arms 18 are configured such that the extension arms friction fit within the channel to prevent the arms from falling out of the channel if the assembly were turned on its side. In such cases, a user may apply a slight amount of force to overcome the friction fit and move the arms within the channel as desired. With respect to horizontally positioned arms 18*a* and 18*b*, the arms can be used to visualize the width of the object to be hung prior to mounting hangers 16 by extending the arms out to the width of the object. In such cases, ends 19*a* and 19*b* can be positioned so that they align with the sides of the object to be hung. Arms 18*a* and 18*b* can also be used to measure distances from other objects to obtain the proper positioning of object hangers 16 on the wall surface.

As mentioned above, each holder 14 defines a vertical slot 24 through which an arm 18 can translate or telescopically extend up and down. In the illustrated embodiment, arms 18*c* and 18*d* are positioned within the vertical slots of holders 14*a* and 14*c*. Arms 18*c* and 18*d* can be used to visualize the height of the object to be hung by aligning tops 19*c* and 19*d* of arms 18*c* and 18*d* with the top of the object. Alternatively, a user can align the bottoms 17*c* and 17*d* of arms 18*c* and 18*d* with the bottom of the object to visualize where the bottom of the object will be positioned prior to mounting hangers 16. Arms 18*c* and 18*d* can also be used to measure distances from other objects above or below where the object will be hung to obtain the proper positioning of object hangers 16 on the wall surface.

In some embodiments it is contemplated that holders 14 may optionally include selective adhesive material on the back surfaces of the holders such that assembly 10 may be selectively and temporarily adhered to the wall surface while object hangers 16 are mounted in the desired locations. It is contemplated that the adhesive material would allow for repeated adherence with and removal from the wall surface, while remaining attached to the back surface of the holders. The adhesive material would allow for the assembly 10 to be selectively attached to the wall surface without being held by the user, so that the user has his hands free to mount the object hangers to the wall surface at the proper locations.

Use of assembly 10 will now be described with reference to FIGS. 1-4. As an example, the use of assembly 10 will be described with reference to an object configured to be hung via a hanging wire attached to the back side of the object. However, it should be appreciated that assembly 10 can be used to aid in hanging objects having a variety of mounting mechanisms, with the wire being only one example. Additionally, the described method involves mounting two hangers 16 to hang the object. However, it should also be appreciated that assembly 10 could be use to mount more or less than two object hangers to hang the object. Initially, a user selects the desired object hangers, such as hangers 16 as an example, with which to hang the object. The selected object hangers could be larger or smaller than the illustrated hangers 16, as desired. A user then approximates the desired distance between the hangers. Once selected and the desired positions determined, the hangers are positioned between holders 14 by sliding the holders along bar 12 to the desired positions and positioning the hangers between the holders so that two adjacent projections 42 cooperate to hold an object hanger 16, as best illustrated in FIG. 3. As described above, to slide a holder 14 along bar 12, a user may press down depressible end 52 to disengage splines 55 from splines 13 on bar 12 and slide the holder to the desired position. In some embodiments, a user can then place the assembly at the desired location on the wall surface with the back surfaces of the hangers contacting the wall surface, level the assembly by using bubble levels 30, and mount hangers 16 to the wall surface while the hangers are held in position by holders 14.

In certain other embodiments, prior to mounting hangers 16 to the wall surface, assembly 10 can be positioned adjacent the back side of the object to be hung, allowing a user to translate arms 18 to the desired positions. In doing so, a user hooks the ends of hangers around the hanging wire and pulls the hanging wire taught, simulating the hanging condition. Thereafter, the user can slide or translate arms 18 within channel 70 and vertical slots 24 of holders 14 to the desired positions. In certain embodiments, a user may position the arms such that the outer ends 19*a* and 19*b* of arms 18*c* and 18*d* align with the sides of the object and the top ends 19*c* and 19*d* of arms 18*c* and 18*d* align with the top of the object to be hung. In other embodiments, a user may position the arms beyond the edges of the object to indicate the distance from another position that the object should be hung.

As an example, if the object to be hung has a width of 24 inches (the example illustrated width of bar 12), and the object is to be hung 4 inches from another object, a user may extend the corresponding arm 18*a* or 18*b* out beyond bar 12 via translation in channel 70 a distance of 4 inches so that a side of the object would be positioned 4 inches from the other object. Thereafter, a user can position the assembly 10 up against the wall surface, abut the particular end 19*a* or 19*b* of the corresponding arm to the adjacent object, and mount the object hangers at the proper locations.

Once arms 18 are positioned as desired, a user can position assembly 10 up against the wall at the desired location, with the back surfaces of object hangers 16 at least partially contacting the wall surface. In certain embodiments in which an adhesive material is applied to the back surfaces of holders 14, assembly 10 may be selectively and temporarily adhered to the wall surface without the need for the user to hold the assembly at the proper position. To mount the object hangers, a user can insert fasteners such as nails, through the holes in the hangers, such as holes 60 and 62 in hanger 16*a* (see FIGS. 3 and 4), and into the wall to mount the hangers. After the hangers are mounted at the desired locations, the user can hang the object on the wall via the object hangers.

In some embodiments, it is contemplated that two or more assemblies 10 could be used together to mount object hangers to a wall surface. In such cases, a user can slide or translate extension arm 18*a* and/or 18*b* beyond bar 12 and position outer end 19*a* and/or 19*b* into a channel 70 of an adjacent assembly 10. Accordingly, the adjacent assemblies 10 could be temporarily and selectively connected together via a horizontally extending extension arm.

In certain embodiments, the components of assembly 10 are composed of a plastic material. However, it should be appreciated that the components can be composed of other appropriate materials as would generally occur to one skilled in the art. Additionally, in certain embodiments, assembly 10 can be assembled as a kit for ease of transport and storage, and can be assembled by a user without the use of tools. In an example embodiment, a kit would consist of one bar 12, four holders 14, four arms 18, and two bubble levels 30. Optionally, the kit could include a plurality of object hangers, such as the illustrated hangers 16.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What is claimed is:

1. An apparatus for aiding in hanging an object on a wall, comprising: an elongate horizontal bar having a longitudinal axis and a top surface; and at least two holders slideable on said bar along the longitudinal axis, wherein each of said holders includes at least one projection for holding an object hanger at the desired mounting location while a fastener is used to mount the object hanger on the wall; wherein positioning at least two of said at least two holders spaced apart from each other on said bar allows for properly positioning and mounting the object hangers held by said projections at the desired locations on the wall, wherein said at least two holders includes at least four holders, wherein each of said holders includes two opposing side projections, wherein each of said projections is configured to be able to cooperate with one of said projections on an adjacent one of said holders to hold an object hanger between said holders.

2. The assembly of claim 1, further comprising at least one level mechanism for indicating when the apparatus is level.

3. The assembly of claim 2, wherein said level mechanism is a bubble level.

4. The assembly of claim 1, wherein said elongate horizontal bar includes measurement indicator lines thereon.

5. The assembly of claim 1, further comprising at least one elongate arm configured to slideably engage said elongate horizontal bar along the longitudinal axis, wherein said horizontal bar defines a channel extending along the longitudinal axis to slideably receive said arm such that said arm can telescopically extend beyond said bar; and wherein said elongate arm includes measurement indicator lines thereon.

6. The assembly of claim 1, further comprising at least one elongate arm configured to slideably engage one of said holders, wherein at least one of said holders defines a vertical slot configured to slideably receive said arm such that said arm can telescopically extend above and below said holder and said bar; and wherein said elongate arm includes measurement indicator lines thereon.

7. The assembly of claim 1, wherein said top surface of said elongate horizontal bar includes a plurality of splines, wherein each of said holders includes a top clamping lever having a first depressible end and a second end with one or more splines configured to engage said plurality of splines on said top surface to prevent slideable movement of said holder along said bar, whereby pressing said first end of said lever moves said splines on said second end out of engagement with said plurality of splines on said top surface to allow said holder to be freely slideable along said bar.

8. The assembly of claim 1, wherein each of said projections is triangular-shaped with a top surface, a back surface, and an angled front surface, wherein each of said angled front surfaces angles toward said back surface in a direction down from said top surface to facilitate insertion of a fastener through a hole in the object hanger without interference with said projections.

9. An apparatus for aiding in hanging an object on a wall, comprising:

an elongate horizontal bar having a longitudinal axis and a top surface; and at least four clamping members slideable on said bar along the longitudinal axis;

wherein each of said clamping members includes two opposing side projections, wherein each of said projections is configured to be able to cooperate with one of said projections on an adjacent one of said clamping members to hold a object hanger between said clamping members at desired positions on the wall;

wherein said clamping members are configured to hold the object hangers such that the back surfaces of the object hangers at least partially contact the wall so that the object hangers may be mounted to the wall while being held at the desired positions by said clamping members.

10. The assembly of claim 9, further comprising at least two level indicators, each of said indicators being coupled to one of said clamping members for indicating when said corresponding clamping member is level.

11. The assembly of claim 9, wherein said elongate horizontal bar includes measurement indicator lines thereon.

12. The assembly of claim 9, wherein said top surface of said elongate horizontal bar includes a plurality of splines, wherein each of said clamping members includes a top clamping lever having a first depressible end and a second end with one or more splines configured to engage said plurality of splines on said top surface to prevent slideable movement of said clamping members along said bar, whereby pressing said first end of said lever moves said splines on said second end out of engagement with said plurality of splines on said top surface to allow said clamping member to be freely slideable along said bar.

13. The assembly of claim 9, wherein each of said projections is triangular-shaped with a top surface, a back surface, and an angled front surface, wherein each of said angled front surfaces angles toward said back surface in a direction down from said top surface to facilitate insertion of a fastener through a hole in the object hanger without interference with said projections.

14. The assembly of claim 9, further comprising at least four extension arms, wherein said elongate horizontal bar defines a central channel along the longitudinal axis configured for slideable translation of at least one of said arms such that said arm may extend beyond said bar along the longitudinal axis, wherein each of said clamping members defines a vertical slot configured for slideable receipt of one of said arms such that said arm can telescopically extend above and below said holder and said bar.

15. The assembly of claim 14, wherein each of said arms includes measurement indicator lines thereon.

16. A kit for aiding in hanging an object on a wall, comprising:

an elongate horizontal bar having a longitudinal axis, a top surface, and a central channel defined in said bar and extending along the longitudinal axis;

at least four holders slideable on said bar along said longitudinal axis, wherein each of said holders includes two opposing side projections, wherein each of said projections is configured to be able to cooperate with one of said projections on an adjacent one of said clamping members to hold an object hanger between said clamping members at desired positions on the wall, wherein each of said holders includes at least one U-shaped member configured to receive a bubble level, wherein each of said holders defines a vertical slot configured to slideably receive an extension arm;

at least two bubble levels for indicating when the apparatus is level, wherein said levels are configured to snap-fit into said U-shaped members so that at least two of said holders carry said at least two bubble levels; and at least four extension arms, wherein each of said arms is configured to be slideably received in said channel or said vertical slots of said holders;

wherein said holders are configured to hold the object hangers such that the back surfaces of the object hangers at least partially contact the wall so that the object hangers may be mounted to the wall while being held in position by said holders.

17. The kit of claim 16, wherein said top surface of said elongate horizontal bar includes a plurality of splines, wherein each of said holders includes a top clamping lever having a first depressible end and a second end with one or more splines configured to engage said plurality of splines on said top surface to prevent slideable movement of said clamping members along said bar, whereby pressing said first end of said lever moves said splines on said second end out of engagement with said plurality of splines on said top surface to allow said clamping member to be freely slideable along said bar.

18. The kit of claim 16, wherein each of said projections is triangular-shaped with a top surface, a back surface, and an angled front surface, wherein each of said angled front surfaces angles toward said back surface in a direction down from said top surface to facilitate insertion of a fastener through a hole in the object hanger without interference with said projections.

19. The kit of claim 16, wherein said elongate horizontal bar and said extension arms each include measurement indicator lines thereon.

* * * * *